United States Patent [19]

Visocky et al.

[11] Patent Number: 4,593,486

[45] Date of Patent: Jun. 10, 1986

[54] MENU AND PRICES DISPLAY DEVICE

[75] Inventors: Joseph E. Visocky, Sharps Chapel; Charles F. Ramsay, Knoxville, both of Tenn.

[73] Assignee: Plasti-Line, Inc., Knoxville, Tenn.

[21] Appl. No.: 686,915

[22] Filed: Dec. 27, 1984

[51] Int. Cl.[4] ..... G09F 11/00

[52] U.S. Cl. ..... 40/490; 40/5; 40/10 R; 40/16; 40/518

[58] Field of Search ..... 40/5, 16, 518, 10 R, 40/446, 490, 364, 471, 576, 611, 618, 489, 16.4

[56] References Cited

U.S. PATENT DOCUMENTS

| | | | |
|---|---|---|---|
| 2,817,914 | 12/1957 | Rosen | 40/5 |
| 2,934,844 | 5/1960 | Bergier et al. | 40/518 |
| 3,939,584 | 2/1976 | Trame | 40/10 R |
| 4,095,359 | 6/1978 | Trame | 40/518 |
| 4,258,490 | 3/1981 | Trame | 40/10 R |
| 4,262,436 | 4/1981 | Clement | 40/518 |
| 4,296,563 | 10/1981 | Clement | 40/518 |
| 4,337,588 | 7/1982 | Clapper | 40/10 R |

*Primary Examiner*—Gene Mancene
*Assistant Examiner*—James Hakomaki
*Attorney, Agent, or Firm*—Brady, O'Boyle & Gates

[57] ABSTRACT

Pricing modules of the type having precoiled numeric indicia tapes are slidably held in guide channels of a mounting trackway assembly. Additional guide channels in the trackway assembly receive customized alpha indicia strips forwardly of the pricing modules. Pricing module locator notches are provided in wall portions of the trackway assembly to interlock with spring locking elements on each pricing module to properly position each module along the mounting trackway assembly. Multiple sections of the mounting trackway assembly can be provided in interlocking engagement.

3 Claims, 12 Drawing Figures

MENU AND PRICES DISPLAY DEVICE

BACKGROUND OF THE INVENTION

Price display devices employing precoiled indicia strips and holders or guideways for such strips are known in the prior art. Examples of such prior art teachings are contained in U.S. Pat. Nos. 3,939,584; 4,095,359; and 4,258,490 issued to Trame. An objective of the present invention is to provide a display device of this general character which has improved utility in a number of respects and which eliminates certain recognized drawbacks of the prior art structures.

More particularly, in the prior art, one of the problems frequently encountered is the inadvertent separation and/or breakage of components by personnel not adequately qualified to adjust or repair the display device. Another common problem in the prior art is frequent misalignment or shifting of pricing modules on their support structures or accidental removal of the module from the support structure while changing prices. In the prior art, buckling and/or bulging of the precoiled pricing tapes frequently occurs. Additionally, some of the prior art devices are restricted to one type of menu system.

The present invention eliminates the above and other deficiencies of the known prior art through the provision of a menu and price display device having uniquely formed pricing modules of either two-piece or one-piece construction, each possessing a simplified finger operated spring locking element which can engage any of a series of locator notches provided along the mounting trackway for the pricing modules, preferably in the vertical wall thereof. The locations of pricing modules can be quickly changed with precision and without removing the module from the mounting trackway assembly.

The improved pricing modules provided in the present invention enable total control of pricing tape placement, that is, each tape is locked on four sides. The pricing module provides an illuminated decimal point. Its precoiled numeric indicia tape can be conveniently operated from the rear of the assembly without removing the display structure from a provided frame or cabinet.

In addition to these specific improvements, the present invention is characterized by simplicity and economy of construction, durability, versatility and convenience of use.

Other features and advantages of the invention will become apparent to those skilled in the art during the course of the following detailed description.

DETAILED DESCRIPTION

Figure 1:
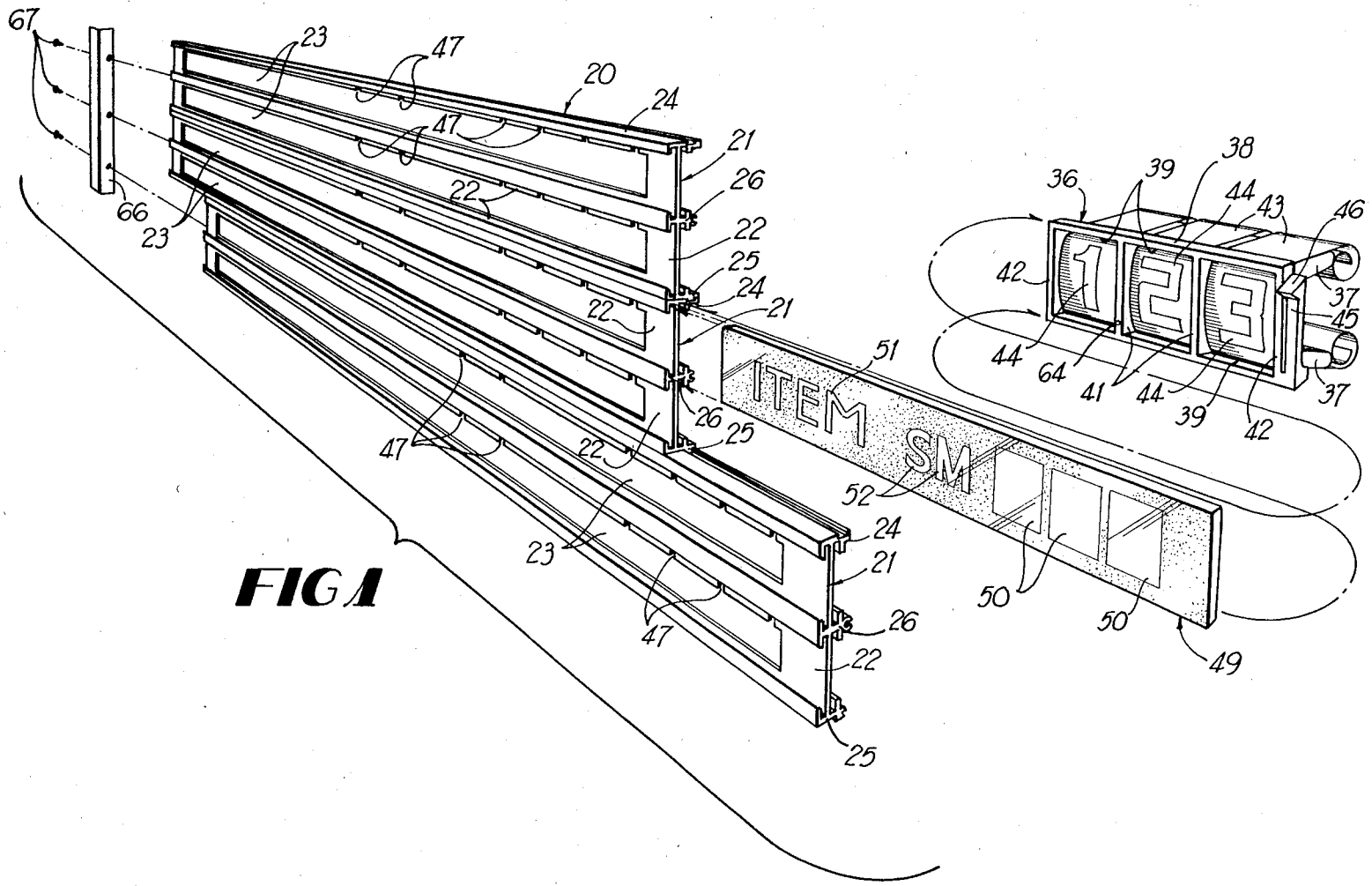
FIG. 1 is an exploded perspective view of a menu and price display device according to the present invention.
Figure 3:
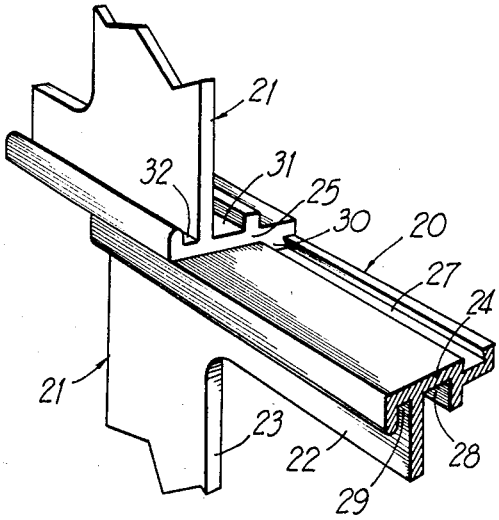
FIG. 3 is a fragmentary perspective view showing components of a mounting trackway assembly.

Referring to the drawings in detail wherein like numerals designate like parts, a menu and price display device typically used in a fast food restaurant or the like comprises a mounting trackway assembly 20, FIGS. 1 and 3, consisting of three identical mounting trackway sections 21, it being understood that one or more of the sections 21 can be employed in the display device, depending upon requirements. Preferably, the mounting trackway sections 21 are metal extrusions.

Each mounting trackway section 21 includes a relatively thin vertical wall 22 having a pair of unobstructed longitudinal slots or window openings 23 formed therethrough. At its top and bottom and at an intermediate point, each mounting trackway section 21 includes a continuous longitudinal extruded portion 24, 25 and 26, as shown. Each portion 24 is provided with an upper continuous longitudinal dovetail groove 27 and two lower continuous longitudinal grooves 28 and 29 of unequal widths. Each lower extruded portion 25 is provided with a bottom continuous longitudinal dovetail tongue 30 and a pair of upper continuous longitudinal grooves 31 and 32 of unequal widths and being disposed in vertical alignment with the grooves 28 and 29.

Figure 2:
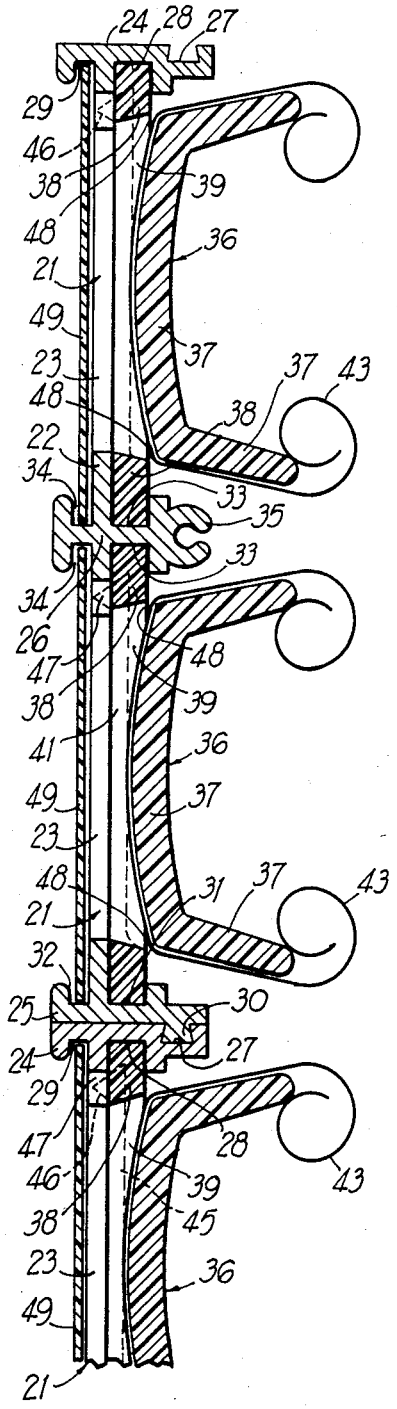
FIG. 2 is an enlarged fragmentary transverse vertical section taken through the assembled device.

The intermediate extruded portion 26 of each mounting trackway section 21 is similarly provided in its top and bottom with continuous longitudinal grooves 33 and 34 of unequal widths which are vertically aligned with the grooves 28 and 29 and 31 and 32, as clearly shown in FIG. 2. Each intermediate extruded portion 26 is further provided on its rear side with a continuous longitudinal circularly curved channel element 35, for a purpose to be described.

As best shown in FIG. 3, plural mounting trackway sections 21, such as the three shown in FIG. 1, are assembled to form a unit by sliding engagement of the described dovetail tongues 30 in the dovetail grooves 27.

The display device further comprises a required number of pricing modules 36 of two-piece construction in accordance with one preferred embodiment of the invention. Each two-piece pricing module 36 includes a molded clear plastics lens 37 and a molded opaque bezel 38. The opaque bezel contains plural side-by-side rectangular window openings 39.

Figure 5:
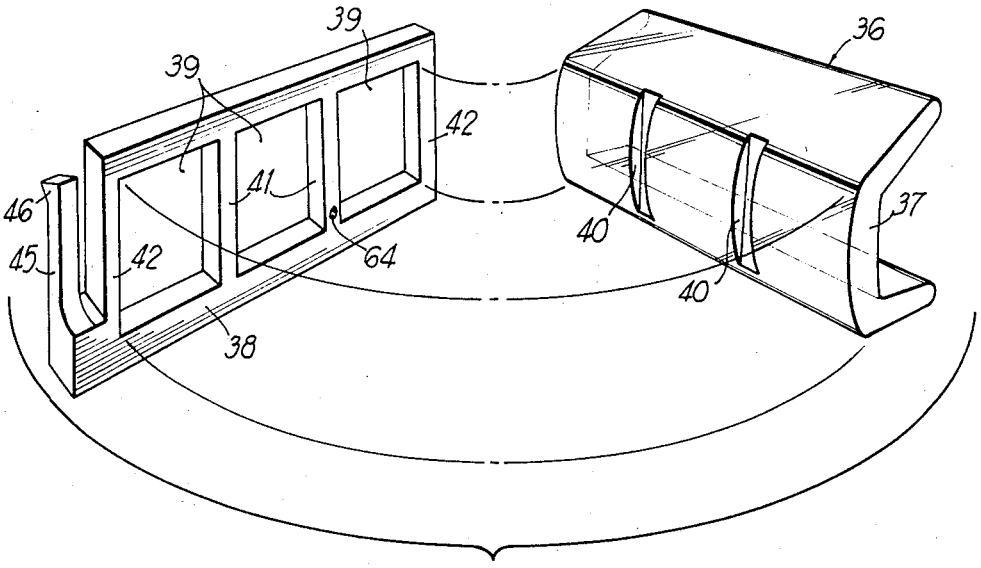
FIG. 5 is an exploded perspective view of the components of the two-piece pricing module prior to assembling.
Figure 6:
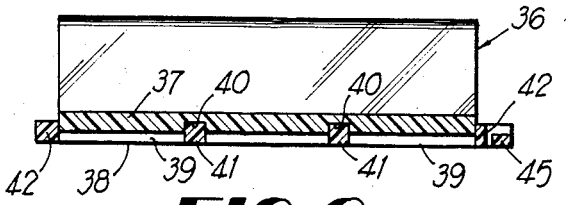
FIG. 6 is a horizontal section taken through the assembled two-piece module.

Each transparent lens 37 in its curved front wall, FIG. 5, has a pair of spaced parallel vertical grooves 40 formed therein for the reception of vertical bars 41 on the bezel 38 separating its window openings 39. When the bars 41 are fully seated in the grooves 40, the bezel 38 is vertically disposed and its two vertical end bars 42 will straddle the end faces of the lens 37, as best shown in FIG. 6. The lens 37 and bezel 38 are permanently joined in assembled relationship by cementing.

The pricing module 36 further includes a conventional manually adjustable precoiled pricing tape 43 adjacent to each window opening 39 of the opaque bezel 38. Each precoiled tape carries pricing indicia, such as a series of numerals 44, 1 through 9 and 0. The tapes 43 may be opaque with their numerals 44 being clear or translucent.

Each pricing module 36 at one end thereof close to the adjacent bar 42 includes a spring lock arm 45 having a tapered locking head 46 at its upper end. The vertical wall 22 of each mounting trackway section 21, adjacent to the top of each slot 23, is provided with a series of spaced locator notches 47, any one of which may receive the tapered locking head 46 to position the pricing module 36 at the desired location along the mounting trackway assembly 20.

The bezel 38 of each pricing module 36 is received slidably within the grooves 28 and 33 or 33 and 31 of each mounting trackway section 21, FIG. 2, whereby the pricing module can be moved longitudinally of the trackway section and locked therein at a desired location caused by interengagement of the locking head 46 with one of the locator notches 47 along the top of the adjacent window opening 23. The frontal curved wall of the clear lens 37 is now adjacent to the opening or slot 23 and also adjacent to the window openings 39 of the bezel 38. Upper and lower feed slots 48 for the precoiled pricing tapes 43 are provided by the assembling of the lenses 37 with their bezels 38 in the described manner. It can be seen that the precoiled tapes are locked and guided on four sides by the feed slots and the adjacent faces of vertical bars 41 and 42, thereby providing easy control of the precoiled tapes from the rear of the modules 36.

Figure 8:
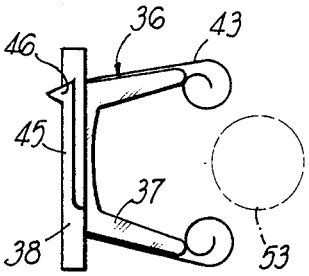
FIG. 8 is an end elevation thereof including the precoiled numeric indicia tape.

Customized opaque elongated copy strips 49 are received slidably within the frontal longitudinal grooves 29–34 and 34–32 of each mounting trackway section 21. The strips 49 extend for the full length of the trackway section 21 and have clear window portions 50 or window openings provided therein in proper spaced relationship to register with the window openings 39 and the pricing indicia 44 of pricing modules 36. The strips 49 near their other ends contain food or beverage item displays 51 in the form of transparent lettering or letter openings in the opaque strips 49. Intermediate portions of the strips 49 may carry additional viewable indicia 52 to indicate portion size of foods and beverages, such as "small", "medium" or "large". A suitable light source 53, FIG. 8, is provided behind the display device, such as a fluorescent tube adjacent to each pricing module. Various conventional lighting arrangements may be used.

In accordance with a modification of the invention shown in FIGS. 9 through 12, an essentially one-piece pricing module 54 may be utilized in lieu of the described two-piece pricing module 36. The one-piece module 54 comprises a united or integral lens 55 and bezel 56, both formed of clear plastics. The one-piece module 54 serves the identical purpose as the two-piece module 35 and functions with the mounting trackway 20 in the exact manner described for the module 36. The one-piece module 54 receives three precoiled pricing tapes 57 which may be identical in construction and operation to the previous described tapes 43. The one-piece module is formed to provide frontal window recesses 58 and vertical bars 59 separating the window recesses. Each module 54 carries a spring arm 60 at one end thereof having tapered locking head 61 at its upper end for interlocking engagement within a selected notch 47 of the mounting trackway assembly 20. The upper and lower longitudinal edge portions of the bezel 56 are received adjustably in the grooves 28–33 and 33–31 in the same manner shown and described for the two-piece module 36 relative to FIG. 2.

Figure 7:
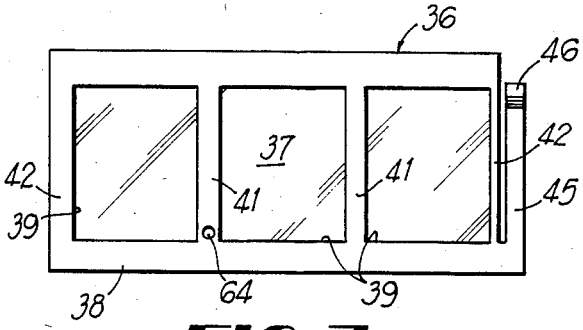
FIG. 7 is a front elevation of the two-piece pricing module.

The entire frontal surface of the bezel 56 is covered by an opaque mask 62, such as a decal. This mask includes a clear decimal point 63 or decimal point aperture so that a decimal point will be displayed for a three digit or two digit price being displayed by the one-piece pricing module 54. Similarly, the opaque bezel 38 of the two-piece module 36 contains a decimal point aperture 64 for the same purpose, FIGS. 5 and 7.

Figure 4:
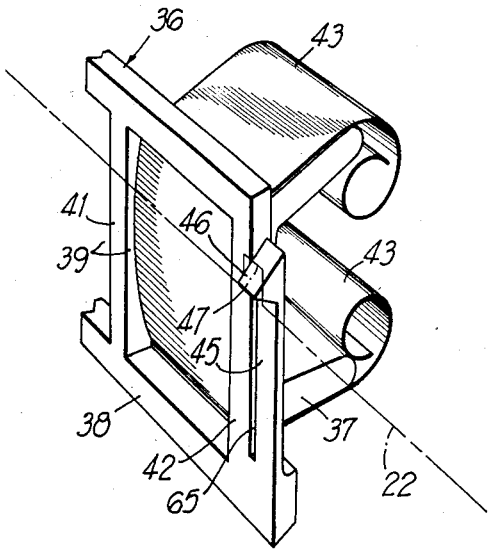
FIG. 4 is a fragmentary perspective view of a two-piece pricing module according to one embodiment.
Figure 9:
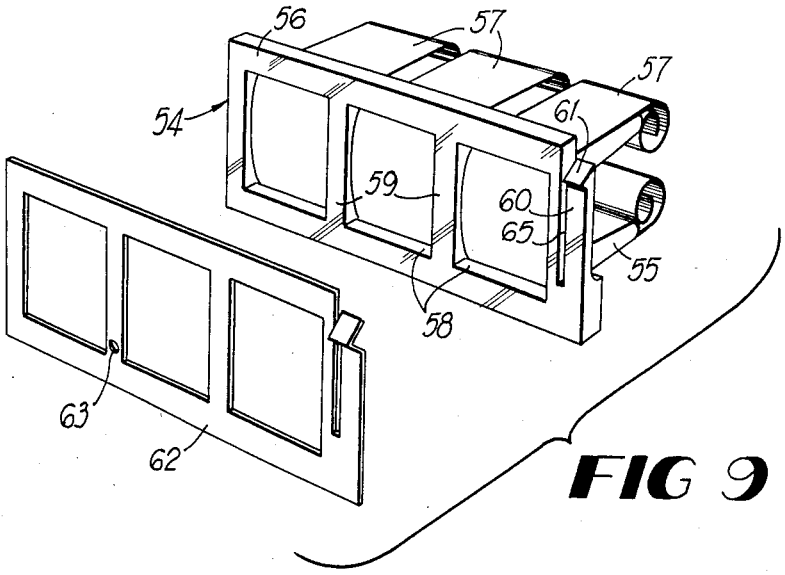
FIG. 9 is an exploded perspective view showing a onepiece pricing module and an associated opaque mask in accordance with a second embodiment.
Figure 10:
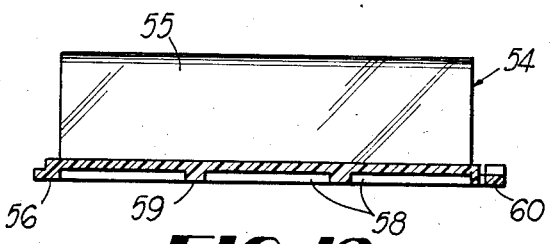
FIG. 10 is a horizontal section taken through the onepiece module in FIG. 9.
Figure 11:
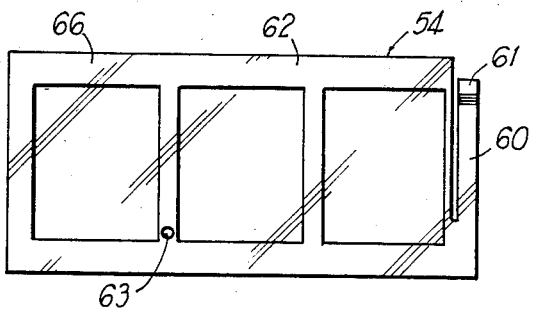
FIG. 11 is a front elevation thereof.
Figure 12:
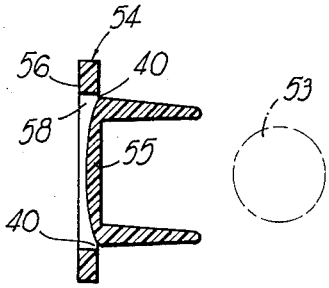
FIG. 12 is a transverse vertical section taken through the one-piece pricing module.

A feature of the invention realized by use of the opaque copy strips 49 is the elimination of frontal light leaks in the display device, such leaks tending to occur at the narrow slits 65, FIGS. 4 and 9, between the spring arms 45 and 60 and the adjacent bars of bezels 38 and 56. Since the opaque strips 49 extend for the lengths of mounting trackway sections 21, they will cover the slits 65 or any other openings through which light could leak from the system. The spacings of the window openings 50 in strips 49 can be varied as can the other indicia on these strips to enable proper registration with the pricing modules.

When the mounting trackway assembly 20 is completed, its sections 21 are connected at their opposite ends by vertical frame members 66 which are apertured to receive screws 67, having self-threading engagement within the extruded circular channel elements 35. The members 66 can be part of a complete framework for the display device, or part of a cabinet structure containing the device.

It may be seen that the stated objectives of the invention which overcome certain deficiencies of the prior art are achieved in a simple and economical manner. A modular display device is created whose mounting trackway assembly can be expanded to meet all needs. Pricing modules in two-piece or one-piece configurations which are self-contained and easy to operate are provided. By virtue of a very simple finger-operated spring lock, the modules 36 and 54 are readily located with precision along the mounting trackway assembly through interlocking of the elements 46 and 47.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A display device comprising a mounting trackway having viewing window openings and at least a pair of spaced opposing parallel trackway grooves, said mounting trackway also having spaced locator notches at intervals along said grooves, a changeable indicia module defining pathways for precoiled indicia tapes, said indicia module having opposite side portions engaging guidably and movably in said grooves of the mounting trackway, and a spring arm attached to the changeable indicia module at one end thereof and including a locking head which project somewhat forwardly of said portions when the spring arm is in a relaxed state, whereby said locking head may engage automatically and releasably in one of said locator notches to position the indicia module at a selected precise location along the mounting trackway.

2. A display device as defined in claim 1, and said mounting trackway including a median wall within which said locator notches are formed, said indicia module including a rectangular bezel which includes said opposite side portions engaging in said grooves of the mounting trackway, and said spring arm extending along one end of the rectangular bezel substantially in right angular relationship to said opposite side portions and said grooves with said locking head arranged near one of said side portions.

3. A display device as defined in claim 1, and said changeable indicia module including a lens and a bezel defining said pathways for precoiled indicia tapes, at least said lens being translucent and said bezel having plural indicia viewing windows adjacent to said pathways, and said pathways including narrow feed slots for precoiled indicia tapes formed between said lens and bezel and further including front and upper and lower surfaces of said lens and spaced surfaces on said bezel, whereby each precoiled indicia tape is guided and restrained in four directions.

* * * * *